United States Patent [19]

Kozacka et al.

[11] 4,336,521

[45] Jun. 22, 1982

[54] ELECTRIC FUSE

[76] Inventors: Frederick J. Kozacka, Main Ave., S. Hampton, N.H. 01913; Richard A. Belcher, Drinkwater Rd., Hampton Falls, N.H. 03844

[21] Appl. No.: 242,771

[22] Filed: Mar. 11, 1981

[51] Int. Cl.[3] ..... H01H 85/14

[52] U.S. Cl. ..... 337/248; 337/252

[58] Field of Search ..... 337/248, 251, 252, 253, 337/190, 201

[56] References Cited

U.S. PATENT DOCUMENTS

| | | | |
|---|---|---|---|
| 3,134,874 | 5/1964 | Cameron | 337/158 X |
| 3,213,242 | 10/1965 | Cameron | 337/159 |
| 4,060,786 | 11/1977 | Cuzzone | 337/248 X |

FOREIGN PATENT DOCUMENTS

| | | | |
|---|---|---|---|
| 1361714 | 4/1964 | France | 337/253 |

*Primary Examiner*—George Harris
*Attorney, Agent, or Firm*—Erwin Salzer

[57] ABSTRACT

An electric fuse having a fuse tube or casing into the ends of which plug terminals are plugged. The plug terminals are conductively interconnected by a plurality of fusible elements, the number of which may change depending upon the desired current-carrying capacity of the fuse. Each plug terminal is provided with a recess in the center thereof. Each recess receives an insert member having a wide flange at right angles to the longitudinal axis of the insert member. A small gap is left between the axially outer end surfaces of the pair of flanges and the axially inner end surfaces of the plug terminals. The fusible elements are held in position by radial slots in the aforementioned flanges into which they are inserted, and their ends are bent 90 degrees and inserted into the aforementioned gap. A solder joint is placed in each slot containing a fusible element conductively connecting the bent ends of the fusible elements, the aforementioned flanges and the plug terminals. One or more additional solder joints may be used for connecting the flanges to the plug terminals.

6 Claims, 5 Drawing Figures

ELECTRIC FUSE

BACKGROUND OF THE INVENTION

This invention relates to fuses whose casing, or fuse tube, is closed by a pair of plug terminals. It is known that this kind of fuse possesses great mechanical strength compared to other designs, and in particular, possesses an ability to withstand large internal pressures which, in turn, is conducive to effective arc extinction. Prior art fuses of the above character, however, have not been cost effective. This is due to the fact that the prior art designs of conductively connecting the ends of the fusible elements to the axially inner surfaces of the plug terminals are relatively involved and inflexible, i.e., adapted to few fuses having like ratings, or having other limitations.

It is, therefore, the prime object of this invention to provide fuses whose casing is closed by plug terminals and which are more cost-effective than prior art fuses of this description.

Another object of this invention is to provide fuses having plug terminals which fuses have various current-carrying capacities without need of any change of the plug terminals to achieve this end, and in which fuses the planar surfaces of the ribbon-type fusible elements are oriented radially, i.e., are arranged in radial planes, which is a preferred design feature in many fuse designs.

Other objects of the invention will become more apparent as this specification proceeds.

SUMMARY OF THE INVENTION

Fuses according to the present invention are provided with a recess, or bore, in the center of the plug terminals. An insert of metal projects into the bore and is firmly held therein. The insert has a flange which extends radially outwardly from the portion of the insert inside the recess, or bore, in each of the plug terminals. The flange portion of the insert is spaced but a little from the immediately adjacent plug terminal and provided with slits extending radially inwardly toward the axis of said recesses, or bores, in the center of the plug terminals. The ends of the fusible elements are bent 90 degrees in either direction, i.e., clockwise, or counter-clockwise, and inserted into the narrow spaces defined by the aforementioned flanges and the plug terminals. The fusible elements are inserted into the above referred to slots in the flange portion of each insert. Thus each fusible element is firmly held in its proper position. The flange portions of the insert members, the bent ends of the fusible elements, and the terminal plugs are conductively interconnected by solder joints.

DESCRIPTION OF PREFERRED EMBODIMENTS

Figure 1:
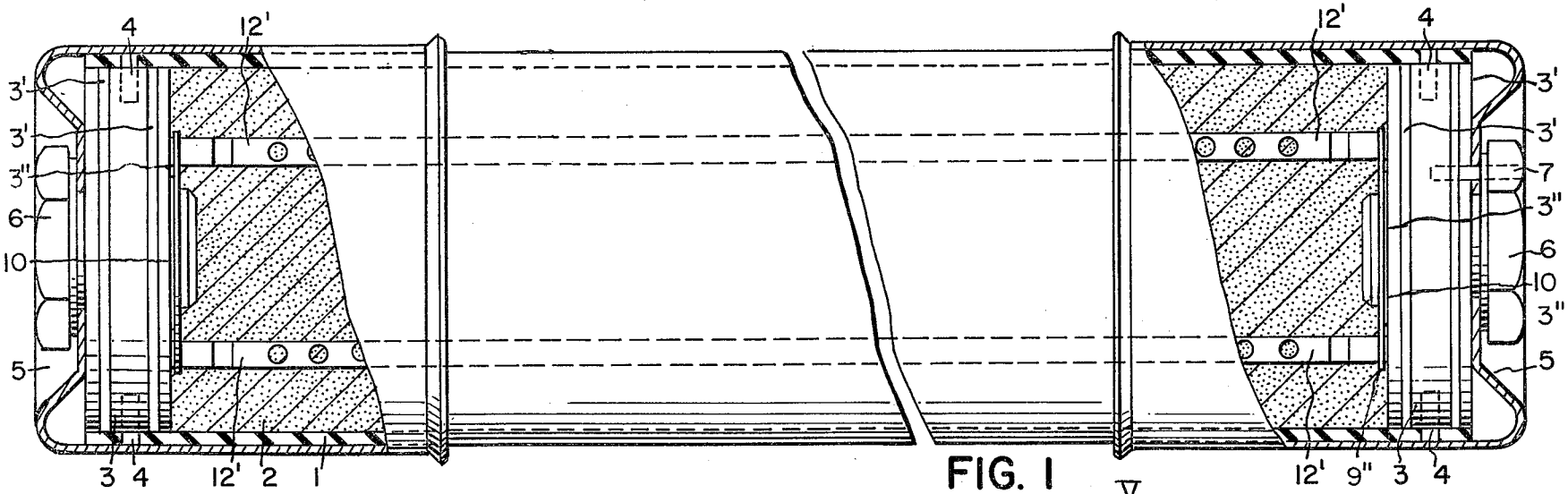
FIG. 1 is substantially a longitudinal section of a fuse embodying the present invention showing some parts thereof in elevation rather than in section.
Figure 3:
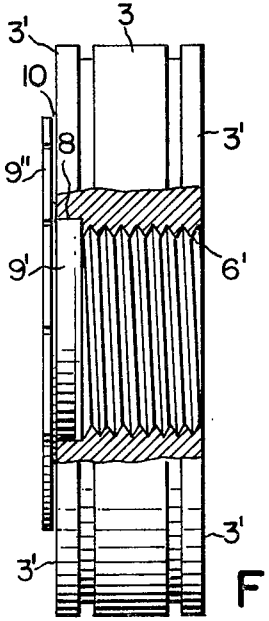
FIG. 3 is a side elevation of the structure shown in FIG. 3 with a portion thereof broken away to show the configuration of parts inside said structure.
Figure 2:
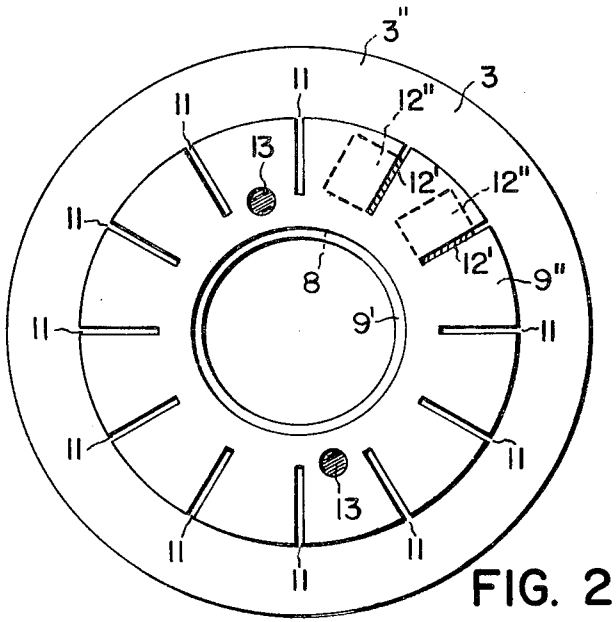
FIG. 2 shows a top plan view of the insert member of the structure of FIG. 1 on a larger scale than FIG. 1.

Referring now to the drawings, and more particularly to FIGS. 1–3 thereof, numeral 1 has been applied to indicate a tubular casing of pressure-proof electric insulating material such as, for instance, a synthetic resin glass-cloth laminate. Casing or fuse tube 1 is filled with a granular arc-quenching filler 2, preferably quartz sand. A pair of plug terminals 3 close the ends of casing 1. Steel pins 4 project through casing 1 into plug terminals 3, and thus firmly connect the latter to the former. Plug terminals 3 are provided with circumferential grooves 3' which may be filled with a plastic material, or provided with O-rings. Caps 5 of sheet metal are mounted over the outer ends of casing 1 and pressed by means of screws 6 against the end surfaces 3'' of plug terminals 3. Screws 6 have male screw threads mating with female screw threads 6' in plug terminals. Their ends may project beyond the axially inner end surfaces 3'' of plug terminals 3. As shown to the right of FIG. 1, a pin 7 may project through screw 6 into terminal plug 3 to preclude screw 6 from getting loose. A pair of recesses 8 is provided each in the center of the axially inner end surface 3'' of one of said pair of plug terminals 3. These recesses 8 are coaxial with female screw threads 6'. The structure according to this invention further includes a pair of inserts 9', 9'' each cooperating with one of plug terminals 3. Each of said inserts has a radially inner portion 9' fitting into one of the recesses 8. This radially inner insert portion is preferably tubular. Each of inserts 9', 9'' has further a radially outer portion or flange 9'' defining a narrow gap 10 between itself and each end surface 3'' of each plug terminal or terminal plug 3. In other words, the flanges or radially outer portions 12'' of inserts 12', 12'' overlap the axially inner end surfaces 3'' of plug terminals 3, but are slightly spaced therefrom. The radially outer portion 9'' of the pair of inserts 9', 9'' is preferably circular. The gaps 10 may be established by various spacing means which may be interposed between the surfaces 3'' of parts 3 and parts 9''. The preferred spacing means will be described below in connection with FIGS. 4 and 5. A plurality of angularly displaced slots 11 extends radially inwardly from the periphery of the radially outer portion 9'' of inserts 9', 9''. The pair of terminals 3 may be conductively interconnected by as many as twelve fusible elements 12', 12'' of which but two have been shown in FIG. 1. Fusible elements 12', 12'' are of the ribbon type rather than the wire type since the fuse is supposed to carry relatively large currents, e.g., 150 amps. Each fusible element 12', 12'' includes a middle section 12' and a pair of end sections 12'' bent at right angles to the middle section 12'. The middle sections 12' of each of said plurality of fusible elements is inserted near the ends thereof into a registering pair of said plurality of slots 11 in said radially outer portion 9'' of said pair of inserts 9', 9''. Since there is an insert 9', 9'' on each end of tube 1, i.e., one to the left of tube 1, and one to the right of tube 1, each fusible element 12', 12'' is supported on each end of tube 1. The bent end sections 12'' of fusible elements 12', 12'' are inserted into the gaps 10 formed between the axially inner end surfaces 3' of plug terminals 3 and the radially outer portions 9'' of inserts 9', 9''. Solder joints (not shown in the drawings) conductively interconnect the radially outer portion 9'' of each pair of inserts 9', 9'', said end sections 12'' of each of said plurality of fusible elements 12', 12'' and said axially inner end surface 3″ of each plug terminal 3. The number of fusible elements 12′, 12″ is increased as the current rating of the fuse is increased. FIG. 1 shows but two fusible elements 12′, 12″ which are angularly displaced 180 degrees and represents the minimal current rating of the fuse.

The narrowness of gap or slit 10 results in a considerable capillary action by which liquified solder is caused to enter slit 10 and to effect reliable conductive bonds between parts 9″, 12″ and 3. As a safety feature two holes 13 are provided in flanges 9″ into which solder is filled. The purpose of these two additional solder joints is to establish current paths of low resistivity between plugs 3 and flanges 9″. The number of solder joints to be positioned at points 13 may be decreased to one, or increased, as desired.

Figure 5:
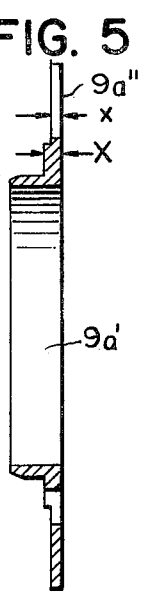
FIG. 5 is a section along V—V of FIG. 4.
Figure 4:
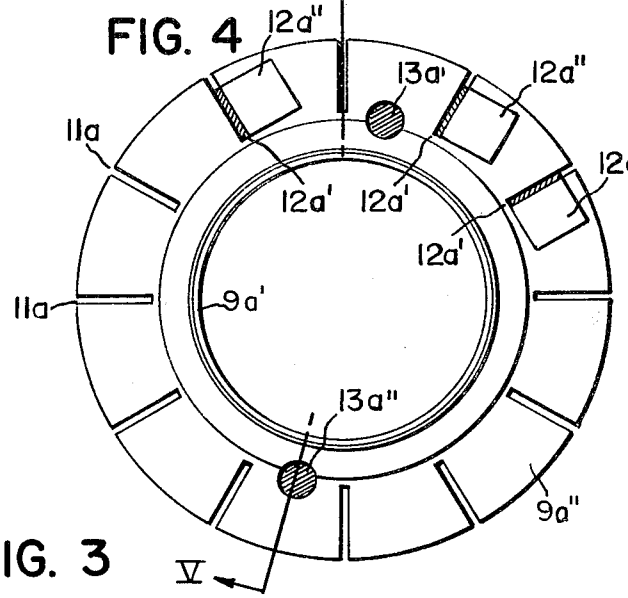
FIG. 4 shows a variation of the structure as shown in FIG. 2 on a larger scale than FIG. 2 and seen from the side opposite to that shown in FIG. 2.

As mentioned above, the narrow spacing 10 between the axially outer end surfaces 3″ of plug terminals 3 and the axially inner end surface 12″ of inserts 12′, 12″ may be achieved in a number of ways of which the most desirable has been shown in FIGS. 4 and 5.

Referring now to FIGS. 4 and 5, the same reference characters as used in FIGS. 1 and 2 with an "a" added have been used to designate like parts. The flange portions 9*a*″ of each of the pair of inserts 9*a*′, 9*a*″ has a relatively large wall thickness X in the region thereof close to their center. The radially outer portion or flanges 9*a*″ of each of said pair of inserts 9*a*′, 9*a*″ has a relatively small wall thickness x in the region thereof close to said plurality of slots 11*a*. Preferably the radially inner portions 9*a*′ are chamfered at the ends thereof projecting into the pair of recesses.

It will be apparent from the above that the ends of slots 11, 11*a* on the periphery of parts or flanges 9″, 9*a*″ are open. The opposite ends of slots 11, 11*a* are closed. It will further be apparent that the slots 11, 11*a* in the flanges 9″, 9*a*″ on the right hand side and on the left hand side of fuse tube 1 are arranged in registry so that the fusible elements 12′, 12″ and 12*a*′, 12*a*″ can be substantially straight, or linear.

The female screw-threads 6′ are of particular importance in assembling a fuse structure according to this invention inasmuch as they have to perform several functions. To assemble fuses according to this invention a center post (not shown) is used which is provided on each of its ends with screw-threads corresponding to the threads of screws 6. This center post serves two purposes. It determines the spacing of terminal plugs 3 and supports terminals 3 and their inserts 9′, 9″ and 9*a*′, 9*a*″, respectively, at a predetermined proper spacing. Thereupon this sub-assembly is loaded with fusible elements 12′, 12″ as described above, which is achieved by rotating the above referred-to center post. When the fusible elements 12′, 12″, or 12*a*′, 12*a*″, respectively, have been inserted into their slots 11 or 11*a*, the sub-assembly is again rotated and while so doing slots 11, or 11*a*, are filled with solder and thus solder joints 13 or 13*a* are made. Thereafter the aforementioned rod is inserted into fuse tube 1 and the latter is connected by pins 4 to plug terminals 3. This allows removal of the aforementioned center post from casing 1. This process calls, of course, for threads of opposite direction in each of the two plug terminals 3. After removal of the center post and its screws that mated with female screw-threads 6′, one of screws 6 is inserted into one of terminal plugs 3, and casing 1 is filled through the other screw-threaded hole 6′ with a pulverulent arc-quenching filler, whereupon that hole is closed by the second screw plug 6. The use of caps or ferrules 5 is not mandatory, however, they may be attached to casing 1 by screw plugs 6 wherever their presence appears to be necessary, or desirable.

The fuse shown in the drawings is a fuse lacking a striker pin for operating another device, such as a disconnect switch, in response to blowing of the fuse, or a blown fuse indicator for indicating that the fuse has blown. In providing such auxiliary devices no radial changes need to be made. All that is needed is to apply appropriate prior art teachings such as, for instance, that of U.S. Pat. No. 3,832,665 to R. A. Belcher; Aug. 22, 1974; or BLOWN FUSE INDICATOR FOR HIGH-VOLTAGE FUSES, or U.S. Pat. No. 4,001,749 to F. J. Kozacka; Jan. 4, 1977 for ELECTRIC FUSE FOR ELEVATED CIRCUIT VOLTAGES.

We claim as our invention:

1. An electric fuse comprising (a) a tubular casing of electric insulating material;

(b) a granular arc-quenching filler inside said casing;

(c) a pair of plug terminals closing said casing;

(d) a pair of recesses each in the center of one of the axially inner end surfaces of one of said pair of plug terminals;

(e) a pair of inserts each having a radially inner portion fitted into one of said pair of recesses, and each having a radially outer portion, said radially outer portion of one of said pair of inserts overlapping the axially inner end surfaces of one of said pair of plug terminals and defining a pair of gaps therebetween;

(f) a plurality of slots extending radially inwardly from the periphery of said radially outer portion of each of said pair of inserts;

(g) a plurality of ribbon-type fusible elements extending between and conductively connecting said pair of plug terminals;

(h) each of said plurality of fusible elements including a middle section and a pair of end sections bent at right angles to said middle section;

(i) said middle section of each of said plurality of fusible elements being inserted near the ends thereof into a pair of said plurality of slots in said radially outer portion of said pair of inserts;

(j) said end sections of each of said plurality of fusible elements being inserted into said pair of gaps defined between said radially outer portion of each of said pair of inserts and said axially inner end surface of one of said pair of plug terminals; and (k) solder joints conductively connecting said radially outer portion of said pair of inserts, said end sections of said plurality of fusible elements and said axially inner end surface of one of said pair of plug terminals.

2. An electric fuse as specified in claim 1 wherein said radially outer portion of each of said pair of inserts has a relatively large wall thickness close to the center thereof, and wherein said radially outer portion of each of said pair of inserts has a relatively small wall thickness in the region thereof close to said plurality of slots.

3. An electric fuse as specified in claim 1 wherein said radially inner portion of each of said pair of inserts is chamfered at the end thereof projecting into one of said pair of recesses.

4. An electric fuse as specified in claim 1 wherein each of said radially outer portions of said pair of inserts is provided with at least one perforation in addition to said plurality of slots, and wherein a solder joint is provided in said perforation for conductively connecting each of said pair of inserts to one of said pair of plug terminals.

5. An electric fuse comprising (a) a tubular casing of a synthetic resin;

(b) a pulverulent arc-quenching filler inside said casing;

(c) a pair of plug terminals fitted into the ends of said casing;

(d) a pair of bores each in the center of one of said pair of plug terminals;

(e) a pair of tubular members each fitted into one of said pair of bores;

(f) a pair of circular flanges on each of said pair of tubular members;

(g) means for slightly spacing said pair of flanges from the axially inner end surfaces of said pair of plug terminals;

(h) a plurality of radially extending angularly spaced slots in said pair of flanges having open ends at the periphery thereof and closed ends spaced from the radially inner ends of said pair of flanges;

(i) a plurality of ribbon-type fusible elements extending between and conductively interconnecting said pair of plug terminals;

(j) each of said plurality of fusible elements including a middle section and a pair of end sections enclosing angles of 90 degrees with said middle section;

(k) the ends of said middle section of each of said plurality of fusible elements being inserted in a registering pair of said plurality of slots in said pair of flanges;

(l) said end sections of each of said plurality of fusible elements being inserted into the spacing of said pair of flanges from the axially inner end surfaces of said pair of plug terminals; and (m) a plurality of solder joints conductively interconnecting each of said plurality of fusible elements, said pair of flanges and said pair of plug terminals.

6. An electric fuse as specified in claim 5 wherein each of said pair of flanges is provided in addition to said plurality of slots with at least one circular bore filled with soft solder for conductively connecting each of said pair of flanges with one of said pair of plug terminals.

* * * * *